US006973956B2

(12) United States Patent
Hohenbichler et al.

(10) Patent No.: US 6,973,956 B2
(45) Date of Patent: Dec. 13, 2005

(54) METHOD AND DEVICE FOR THE CONTINUOUS PRODUCTION OF A ROLLED METAL STRIP FROM A MOLTEN METAL

(75) Inventors: Gerald Hohenbichler, Linz (AT); Gerald Eckerstorfer, Linz (AT)

(73) Assignee: Voest-Alpine Industrieanlagenbau GmbH & Co., (AT)

( * ) Notice: Subject to any disclaimer, the term of this patent is extended or adjusted under 35 U.S.C. 154(b) by 0 days.

(21) Appl. No.: 10/493,614

(22) PCT Filed: Oct. 11, 2002

(86) PCT No.: PCT/EP02/11406

§ 371 (c)(1),
(2), (4) Date: Apr. 23, 2004

(87) PCT Pub. No.: WO03/035291

PCT Pub. Date: May 1, 2003

(65) Prior Publication Data

US 2005/0082030 A1 Apr. 21, 2005

(30) Foreign Application Priority Data

Oct. 24, 2001 (AT) ..... A 1689/2001

(51) Int. Cl.[7] ..... B22D 11/12
(52) U.S. Cl. ..... 164/476; 164/417; 29/527.7
(58) Field of Search ..... 164/476, 417; 29/527.5, 527.6, 527.7

(56) References Cited

U.S. PATENT DOCUMENTS 5,503,217 A * 4/1996 Perry et al. ..... 164/477
5,904,204 A * 5/1999 Teraoka et al. ..... 164/417

FOREIGN PATENT DOCUMENTS

| | | |
|---|---|---|
| EP | 0 540 610 | 5/1993 |
| EP | 0 760 397 | 3/1997 |
| EP | 0 776 984 | 6/1997 |
| WO | WO 99 24186 | 5/1999 |
| WO | WO 01/58612 | 8/2001 |

OTHER PUBLICATIONS

International Search Report dated Jan. 23, 2003.

* cited by examiner

*Primary Examiner*—Kuang Y. Lin
(74) *Attorney, Agent, or Firm*—Ostrolenk, Faber, Gerb & Soffen, LLP

(57) ABSTRACT

The invention relates to a method and to a device for producing a rolled metal strip from a molten metal by producing a cast metal strip in a strip casting device and then rolling the undivided metal strip in a roll stand to the final thickness of the strip. For controlling the course of the strip, strip guiding devices are provided upstream of the roll stand. In order to provide a stable insertion of the metal strip into the roll stand at the input side of the roll stand or at the site of rolling in accordance with the strip dimensions, the strip guidance interferes or is carried out at a distance of 1.0 to 10.0 times the strip width, preferably at a distance of 1.5 to 5.0 times the strip width, upstream of the roll stand.

16 Claims, 3 Drawing Sheets

METHOD AND DEVICE FOR THE CONTINUOUS PRODUCTION OF A ROLLED METAL STRIP FROM A MOLTEN METAL

BACKGROUND OF THE INVENTION

The invention relates to a process for continuously producing a rolled metal strip from a metal melt, in particular a steel strip, in which, in a first production step, melt is introduced into a strip-casting device, and a cast metal strip with a strip thickness of less than 20 mm, preferably between 1 mm and 12 mm, and a predetermined strip width exits from the strip-casting device, and in a second, subsequent production step, the cast, undivided metal strip is roll-deformed in at least one rolling stand until it reaches its final strip thickness. The metal strip is positioned in the roll nip by a strip diversion mounted upstream of the rolling stand. The invention also relates to an apparatus for carrying out this process, and to a method for starting up this installation.

A process of this type and a corresponding apparatus for producing a rolled steel strip from a steel melt, in which a thin cast strip is produced using the two-roller casting process using a two-roller casting device, and is hot-deformed directly from the hot casting stage in a direct further processing step carried out in a rolling stand, are already known from EP-B 540 610 and EP-A 760 397.

Furthermore, it is known from EP-B 540 610 to provide pinch roll stands at a plurality of locations in the production installation, in order to ensure reliable transportation of the cast strip from the two-roller casting machine to the strip-winding device. A diverting roll for adjusting the strip conveying after it leaves the looping pit is also provided immediately downstream of the two-roller casting installation and before the first pinch roll stand. This first pinch roll stand is intended to prevent transverse migratory movement of the strip in the installation. However, this is only possible within a limited conveying section. Furthermore, pinch roll stands are positioned upstream and downstream of trimming shears, in order to keep the steel strip under tension during longitudinal trimming.

EP-A 760 397 likewise discloses a two-roller casting installation with a downstream rolling stand for in-line deformation of the metal strip. According to one of the embodiments described, a pair of pinch rolls is mounted at a distance upstream of the rolling stand, in order to keep the cast strip under tension on the entry side of the rolling stand. In addition a dancer roll is positioned in a strip loop, between the pair of pinch rolls and the rolling stand, in order to avoid a meandering strip path when it enters the rolling stand (FIG. 3). According to a further embodiment, a plurality of diverting or pinch rolls are arranged, as required, at a successive distance from one another in a temperature-controlled region upstream of the rolling stand, in order to avoid this disruptive strip path (FIG. 7).

SUMMARY OF THE INVENTION

Therefore, it is an object of the invention to avoid these described drawbacks of the prior art and to propose a process and an apparatus which ensure a stable strip entry for the metal strip to the rolling stand on the entry side of the rolling stand or the location of rolling deformation, as a function of the strip dimensions, with little outlay on equipment.

In a process of the type described in the introduction, this object is achieved by virtue of the fact that the strip diversion takes effect or is carried out at a distance of 1.0 times to 10.0 times the strip width, preferably at a distance of 1.5 times to 5.0 times the strip width, upstream of this rolling stand. It has been possible to establish a fundamental relationship between the strip width of the metal strip which is to be rolled and the optimum location for use of the strip-diverting measures, insofar as the diversion measures can be carried out at a greater distance upstream of the rolling stand in the case of wider strips. If the strip diversion takes place too close to the rolling stand, unstable performance (e.g. overshooting characteristics, excessively extended edges, etc.) of the strip diversion must be expected. On the other hand, the strip also runs off-center if the strip-diversion measures take place at an excessively great distance upstream of the rolling stand. In this case, the diversion effects are lost again even before the rolling stand is reached.

An optimum strip path is established if the metal strip, in a region upstream of the rolling stand, between a strip-diverting device and the roll nip, is held under a strip tension of between 2.0 MPa and 15 MPa, preferably between 4.0 MPa and 8.0 MPa. If the strip tension is too low, the strip runs off-center, for example as a result of compressive stresses on one side. This manifests itself through instability, e.g. through the strip wobbling. On the other hand, the risk of the strip cracking rises as the strip tension increases. Since the strip temperature is kept high in this region, the strength of the metal strip is correspondingly lower, and therefore so is the acceptable compressive force which can be applied to the metal strip without the pinch rolls producing indentations therein.

To accurately control the center position of the strip, it is necessary for the actual lateral deviation of the metal strip from the predetermined strip-running direction to be recorded, preferably close to the location where the strip diversion acts on the metal strip, and for the position of actuators of the strip-diverting device to be controlled as a function of this parameter.

The strip path can be additionally stabilized if the metal strip is held under a strip pretension in a region upstream of the strip-diverting device. The strip tension can be kept at a lower level in this region than in the subsequent entry region to the rolling stand and serves predominantly to settle and support the metal strip emerging from the casting machine. Preferably, the strip pretension is produced or set by means of the intrinsic weight of the metal strip hanging down in a looping pit. Alternatively, the strip pretension can be produced or set by a braking force which acts in the opposite direction to the strip-running direction.

The strip path can be further stabilized if a strip-running centering aid acts on the metal strip, upstream or downstream of the location of the rolling deformation, at a distance from the location of action of the strip diversion which corresponds to 1.0 times to 10.0 times the strip width, preferably 1.5 times to 5.0 times the strip width. This is important in particular in the operating phases in which the rolling stand is open, i.e. in which no rolling deformation of the metal strip is taking place, in particular in the start-up phase of the production sequence. At the same time, the strip-running centering aid serves as a fixed point for the strip center-position control, in order to be able to sufficiently center the strip despite the low strip tensions.

To produce a cast metal strip with a strip thickness of less than 20 mm, preferably between 1 mm and 12 mm, and a hot-rolled metal strip formed in a continuous production process, the invention also proposes an installation, comprising a strip-casting device, preferably a two-roll casting machine, and at least one downstream rolling stand for in-line roll forming of the cast, undivided metal strip, as well as a strip-diverting device arranged between the strip-casting device and the rolling stand. This installation is characterized in that the strip-diverting device is arranged at a distance of 1.0 times to 7.0 times the strip width, preferably at a distance of 1.5 times to 5.0 times the strip width, upstream of the rolling stand. This strip-diverting device is preferably formed by a multi-roll driver, preferably by a two-roll driver.

An advantageous refinement of this installation, with the advantages described above, results if metal-strip conveyor means, preferably the pinch rolls of a multi-roll driver, which interact with adjustment and control devices and by means of which the setting of a strip tension of between 2.0 MPa and 10 MPa, preferably between 4.0 MPa and 7.0 MPa, between the strip-diverting device and the rolling stand or the strip-running centering aid or another unit in the strip-running line can be predetermined, are arranged in the strip-diverting device.

Optimum action on the strip path is achieved if the strip-diverting device is assigned a strip-position measuring device, and metal-strip conveyor means, preferably the pinch rolls of a multi-roll driver, are arranged in the strip-diverting device, at least one of the metal-strip conveyor means being supported rotatably in a bearing device which can pivot about an axis, these means interacting with control devices for influencing the strip-running direction. The pivotable axis is preferably oriented vertically as a vertical axis or parallel to the strip-running direction.

According to an advantageous embodiment, the strip-diverting device itself forms the pivotable bearing device, and the latter is supported displaceably on guides and connected to an adjustment drive, which is preferably a coupling mechanism. Other mechanical, electromechanical, hydraulic or electrohydraulic drives are also possible. The guides may be formed by four-bar linkages or other kinematic mechanisms, rails, bars, rolls, etc.

In order to position the strip-diverting device at the appropriate distance upstream of the rolling stand, as a function of the strip width of the strip-diverting device, the strip-diverting device is supported on guides, and a displacement device for the strip-diverting device is arranged between strip-diverting device and guides. The guides are oriented parallel to the strip-running direction.

To achieve optimum strip running, it is also proposed that a device for producing a strip pretension in the metal strip is arranged between the strip-casting device and the strip-diverting device. This device may, for example, be formed by a looping pit, in which case it is substantially the length of the loop hanging down which determines the strip tension. In addition, the strip loop hanging down acts as a damping element between the two-roll casting device and the rolling stand, with the result that disruptive feedback between the successive process steps is avoided. According to another embodiment, the device for producing a strip pretension is formed by a strip-supporting device which is preferably horizontal and subject to friction, in particular a roller table with braking rolls. Simple, immobile, mechanical supporting elements which are subject to friction may be provided between the braking rolls or at the location thereof. In this case, it is the length of the strip-supporting device which determines the strip tension, the active length of the strip-supporting device amounting to at least 1.5 times the strip width, preferably at least 2.5 times the strip width. The active length is the length of the roller table fitted with braking rolls.

To maintain the diverting function in the region of the rolling stand, in particular with the roll nip open, it is proposed that a strip-running centering aid, preferably a non-divertible two-roll or three-roll driver, is arranged downstream of the rolling stand or between the strip-diverting device and the rolling stand. The strip-diverting device and the strip-running centering aid are arranged at a distance of 1.0 times to 10.0 times the strip width, preferably at a distance of from 1.5 times to 5.0 times the strip width, from one another. It follows from this that the rolling stand and the strip-diverting device are positioned very close together if the strip-running centering aid is located downstream of the rolling stand, and that the rolling stand and the strip-diverting device are further apart from one another if the strip-running centering aid is positioned upstream of the rolling stand.

To ensure that the production process or installation is run up in a stable way during the starting phase, a start-up method for the installation is proposed, this method being characterized by the following method steps:

- the cast metal strip which leaves the strip-casting device is passed through the installation and threaded into the strip-coiling device substantially at a strip-running velocity, with the roll nip of the rolling stand open, which corresponds to the casting rate,
- a controlled strip tension is set between a strip-diverting device and a strip-running centering aid connected upstream of the rolling stand or a strip-running centering aid connected downstream of the rolling stand or the strip-coiling device,
- simultaneously or subsequently a controlled strip diversion is applied at a distance upstream of the rolling stand,
- the working rollers of the rolling stand are set to a roll nip which corresponds to the final strip thickness, and
- the rolling speed is matched to the casting rate.

The controlled strip diversion is in this case applied to the metal strip, which is under strip tension, at a distance, which corresponds to 1.0 times to 10.0 times the strip width, preferably 1.5 times to 5.0 times the strip width, of the cast metal strip, upstream of the rolling stand. The controlled strip tension between the strip-diverting device and the strip-coiling device or a strip-running centering aid is advantageously kept at a value of between 2.0 MPa and 15 MPa, preferably between 4.0 MPa and 8.0 MPa. This strip tension is applied even before the working rollers are moved onto the cast metal strip, i.e. before the rolling operation commences, and is maintained during the rolling operation.

BRIEF DESCRIPTION OF THE DRAWINGS

Further advantages and features of the present invention will emerge from the following description of non-restrictive exemplary embodiments, in which reference is made to the appended figures, in which.

DESCRIPTION OF PREFERRED EMBODIMENTS

In the embodiments shown in FIGS. 1 to 3, which are described below, identical components are denoted by identical reference symbols.

Figure 1:
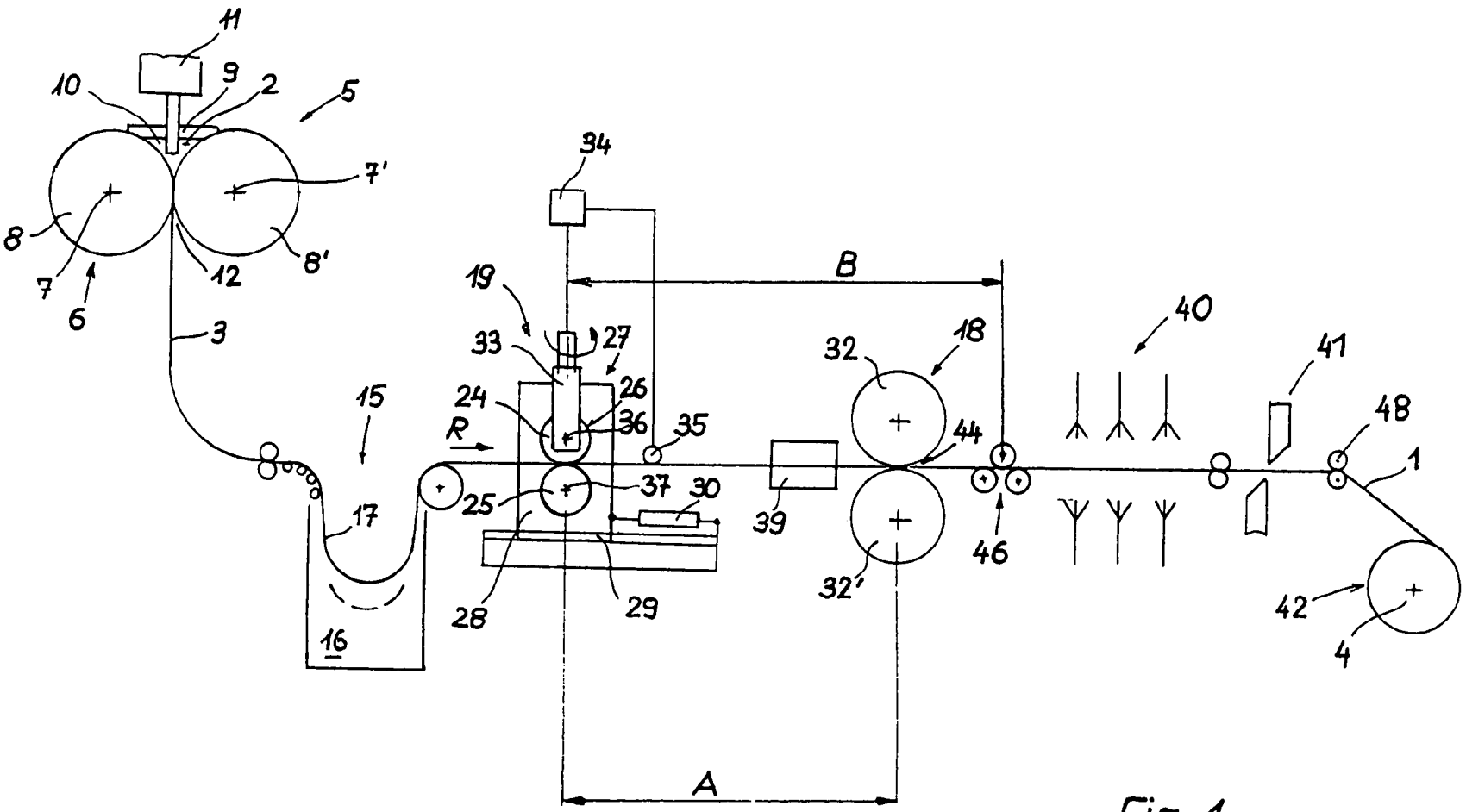
FIG. 1 diagrammatically depicts the installation according to the invention in a first embodiment, FIG. 2 diagrammatically depicts the installation according to the invention in a second embodiment.
Figure 2:
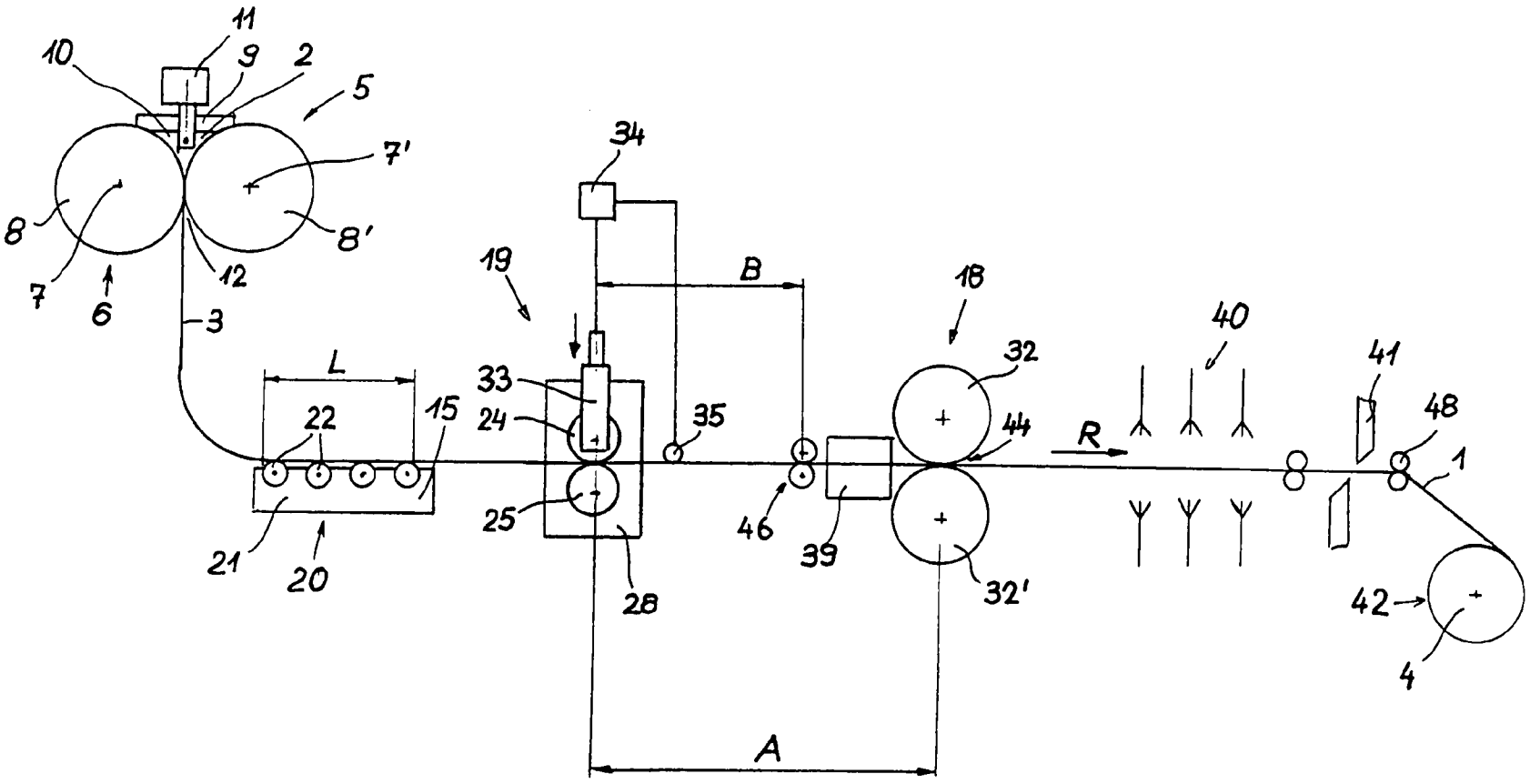

FIGS. 1 and 2 show an installation according to the invention for the continuous production of a rolled metal strip 1 from a metal melt 2, in which, in a first production step, a cast metal strip 3 is produced from the metal melt, and in a second production step, which directly follows the first, the cast metal strip 3 is subjected to hot deformation in a rolling process. The rolled metal strip 1 produced in this manner is then wound up into coils 4 of predetermined weight, if appropriate after having undergone a controlled cooling process, which is not described in more detail in the context of the present invention.

A strip-casting device 5 whose strand-forming core unit is formed by a single belt, running horizontally at the underside, or a plurality of revolving belts, caterpillars or mold walls, is used to produce the cast metal strip with a strip thickness of between 1.0 and 20 mm. FIG. 1 diagrammatically depicts, as one possible embodiment, a two-roller casting machine 6 which is formed by two casting rollers 8, 8', which rotate about horizontal axes 7, 7', and together with side walls 9 which are pressed onto the casting rollers at the end sides forms a mold cavity 10 for receiving the metal melt 2, which is supplied via a tundish 11. In a fast-moving solidification process, the cast metal strip 3 is formed in a casting nip 12 between the casting rollers 8, 8' and is conveyed out at the bottom. The cast metal strip 3 is then diverted into the horizontal and passes through a device 15 for producing a strip pretension, which is formed by a looping pit 16. The strip loop 17 hanging down in the looping pit 16 also compensates for temporary, production-related differences in speed in the strip as it runs between the strip-casting device 5 and the rolling stand 18. The length of the strip loop 17 hanging down exerts a gentle pretension on the cast metal strip 3 and ensures stabilized, uniform strip running to the downstream strip-diverting device 19.

In a further embodiment, which is diagrammatically depicted in FIG. 2, the device 15 for producing a strip pretension and therefore the pretension acting on the metal strip is realized by a horizontally oriented strip-supporting device 20 which decelerates the cast metal strip 3 sliding over it. This braking action is produced by braking rolls 22 mounted in the roller table 21 of the strip-supporting device 20, a roller table length L which corresponds to 1.5 times to 2.5 times the strip width of the cast metal strip 3 being sufficient for this purpose.

The strip-diverting device 19 is equipped with adjustable metal-strip conveyor means 26 formed by pinch rolls 24, 25. In accordance with FIG. 1, the strip-diverting device 19 is designed as a two-roll driver 27 and is arranged at a distance A, which is partly determined by the width of the cast metal strip 3, upstream of the rolling stand 18. This distance A is in a range which amounts to 1.0 times to 10.0 times the strip width. The stand frame 28 of the strip-diverting device 19 is supported on guides 29, which may be configured as sliding guides or roller guides, and is moved into the predetermined position, which is dependent on the strip width (distance A), by a displacement device 30, which is designed as a pressure cylinder and engages on the stand frame 28 on one side and on the guides 29 on the other side. Furthermore, the pinch rolls 24, 25 of the two-roll driver 27 exert a braking force on the metal strip passing through the working rollers 32, 32' of the rolling stand 18, this braking force corresponding to a strip tension of between 2.0 MPa and 15.0 MPa.

The strip-diverting function can be performed using various embodiments of the strip-diverting device 19 in conjunction with a strip-position center control.

According to the embodiment illustrated in FIG. 1, the adjustable pinch roll 24 is supported rotatably in a pivotable bearing device 33 and is coupled to a corresponding adjustment and control device 34 and to a strip-position measuring device 35 in order for it to be positioned. The strip-position measuring device 35 is arranged close to and downstream of the strip-diverting device 19. It is also possible for the strip-position measuring device to be positioned upstream of the strip-diverting device. This strip-position measuring device is used to record the deviation of the metal strip from the predetermined strip-running center and to transmit a corresponding signal to the adjustment and control device 34. The pivoting movement of the bearing device 33, which results in an inclined position of the axis 36 of a pinch roll 24 in relation to the axis 37 of the further pinch roll 25 (rotary adjustment in the direction indicated by the arrow) or of both pinch rolls (24, 25) supported in a common bearing device in relation to the instantaneous strip-running direction, this inclined position amounting to at most a few degrees, allows the cast metal strip 3 to be oriented to the predetermined strip-running direction R and thereby ensures that the metal strip passes centrally through the downstream rolling stand 18.

FIG. 2 diagrammatically depicts an embodiment in which controllable compressive forces are applied to the pivotable bearing device 33 of the pinch roll 24 in the direction indicated by the arrow, preferably in the region of the opposite bearing locations of the pinch roll in the pivotable bearing device 33. The transverse forces which in this case flow into the cast metal strip 3 transversely to the strip-running direction R displace the strip-running in the direction of these transverse forces.

Figure 3:
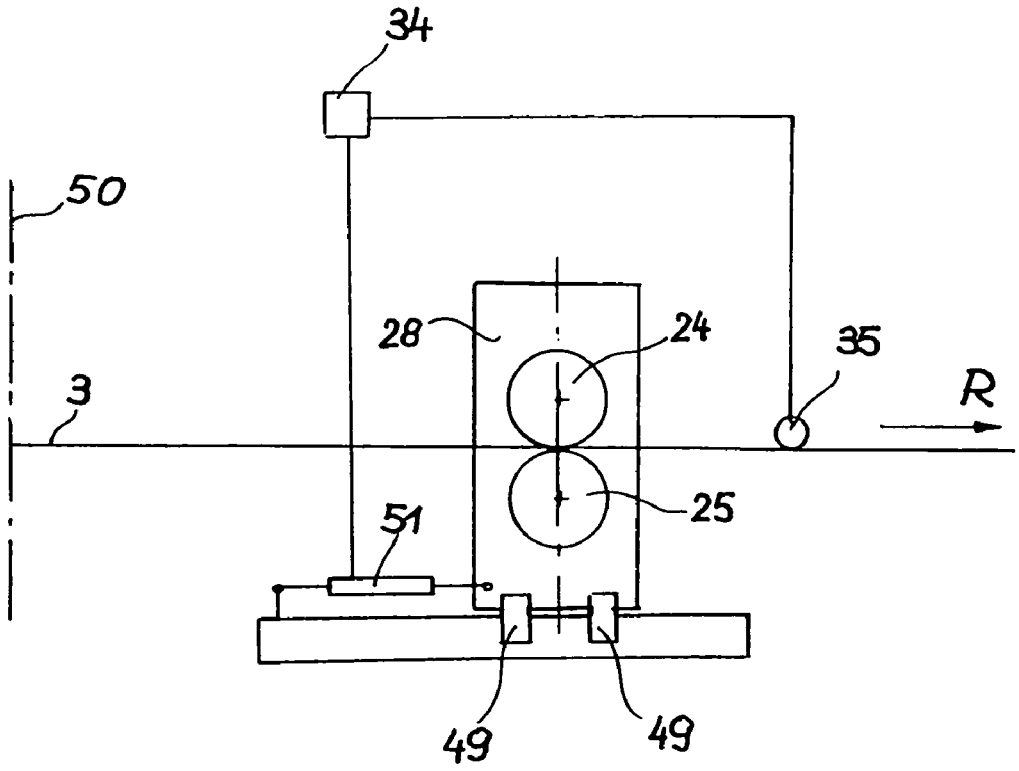
FIG. 3 shows a preferred embodiment of the strip-diverting device according to the invention.

FIG. 3 diagrammatically depicts a preferred embodiment of the strip-diverting device 19. The stand frame 28 which accommodates the pinch rolls 24, 25 is supported, in such a manner that it can pivot about a vertical axis 50, by means of curved, in particular arcuate, guides 49, and the orientation of the stand frame 28 with respect to the strip-running direction R can be set by means of a pivoting device 51, which is formed, for example, by hydraulic or electromechanical actuating devices, in particular also having a coupling mechanism. The vertical axis 50 represents the instantaneous center of rotation of the pivoting movement. The transverse forces or differential strip tensions which thereby act on the metal strip displace the strip-running direction in the direction of these transverse forces.

The strip-diverting device 19 is assigned a strip-position measuring device 35, e.g. an optical, capacitive or inductive measurement system, which determines the actual position of the strip edges and/or of the strip center of the metal strip. The measurement results determined are fed to a control device, from which control signals are emitted to the respective actuators of the strip-diverting device.

To allow sufficient strip centering to be realized despite the low strip tension, a strip-running centering aid 46 is positioned downstream of the strip-diverting device 19, either upstream or downstream of the rolling stand 18. This strip-running centering aid forms a fixed point for the strip diversion and, when the rolling stand 18 is closed, has an additional stabilizing action on the strip running. In FIG. 1, the strip-running centering aid 46 is diagrammatically depicted as a three-roll driver and is illustrated on the outlet side of the rolling stand 18, while in FIG. 2 the strip-running centering aid 46 is illustrated as a two-roll driver on the inlet side of the rolling stand 18.

In a hot-deformation process, which takes place in the rolling stand 18 (two-high, four-high or six-high rolling mill), the cast metal strip 3 is rolled, with a degree of reduction of up to 50%, in an in-line rolling operation to form a hot-rolled metal strip 1 with a predetermined final strip thickness. If multi-stand rolling trains are used, it is possible to achieve higher degrees of reduction and therefore lower final strip thicknesses. To set a predetermined, uniform rolling temperature, it is possible for a temperature-compensation zone 39, which is formed by a temperature-compensation tunnel furnace or a strip edge heater, to be connected upstream of the rolling stand 18. After it has left the rolling stand 18, the metal strip 1 is subjected to controlled cooling in a cooling section 40, is divided up using transverse cutting flying shears 41 at locations corresponding to the desired coil weight, and is wound up into coils 4 in a strip-coiling installation 42.

During the start-up operation, in which the first piece of a cast metal strip is threaded through the installation at casting speed using, for example, a start-up strand, the roll nip 44 of the rolling stand 18 is open. The start-up strand is separated from the cast metal strip using the transverse cutting flying shears and the metal strip is fed to the coiling installation, where it starts to be wound up. Even before it starts to be wound up, a strip tension is built up, in particular between the strip-diverting device 19 and the strip-running centering aid 46, and at the same time or subsequently a predetermined strip tension is set. Subsequently, the working rollers 32, 32' of the rolling stand are moved together so as to move to the desired roll nip 44, and the coiling speed is matched to the degree of deformation which is set in the rolling stand. In this way, steady-state operation of the installation is achieved. As an alternative to the strip-running centering aid 46, it is also possible for the strip-coiling installation 42 or the entry driver 48 connected upstream of it to be used to build up the strip tension. Each driver arrangement positioned between the strip-diverting device 19 and the strip-coiling installation can perform this function and is therefore covered by the scope of protection of the present invention.

What is claimed is:

1. A process for continuously producing a rolled metal strip from a metal melt comprising from the metal melt, forming a cast, undivided metal strip with an initial strip thickness of less than 20 mm and with a strip width; passing the strip along a path;

roll deforming the cast, undivided metal strip until the strip reaches a final strip thickness; and prior to the roll deforming, passing the metal strip through a strip diversion located upstream in the path of the metal strip from the roll deforming, wherein the strip diversion is performed at a distance of between 1.0 and 10.0 times the width of the strip upstream of the roll deforming.

2. The process of claim 1, wherein the strip diversion is performed at a distance of 1.5 times to 5.0 times the strip width upstream of the roll deforming.

3. The process of claim 1, wherein the metal strip is formed by introducing the metal melt into a strip casting device and forming the metal strip of the first thickness in the strip casting device, wherein the metal strip is roll deformed in a rolling stand, and the strip diversion is upstream of the rolling stand.

4. The process of claim 3, wherein the initial strip thickness is between 1 mm and 12 mm.

5. The process of claim 1, wherein between the strip diversion and the roll deforming, the method comprising holding the metal strip under a strip tension of between 2.0 MPa and 15 MPa.

6. The process of claim 1, wherein between the strip diversion and the roll deforming, the method comprising holding the metal strip under a strip tension of between 4.0 MPa and 8.0 MPa.

7. The process of claim 3, further comprising recording actual lateral diversion of the metal strip from a predetermined strip-running direction on the path and controlling the position of actuators of the strip diverting device as a function of the measured lateral diversion.

8. The process of claim 7, further comprising recording the actual lateral diversion at a location close to the location of the strip diversion of the metal strip.

9. The process of claim 5, further comprising holding the metal strip under a strip pretension at a region of the path upstream of the strip diversion.

10. The process of claim 3, further comprising holding the metal strip under a strip pretension at a region of the path upstream of the strip diversion.

11. The process of claim 10, wherein the strip pretension is set by the intrinsic weight of the metal strip hanging down in a loop.

12. The process of claim 10, wherein the strip pretension is produced by applying a braking force in the opposite direction to a strip running direction along the path.

13. The process of claim 3, further comprising a strip-running centering aid located upstream or downstream of the location of roll deformation and at a distance from the location of the strip diversion corresponding to 1.0 times to 10.0 times the strip width.

14. The process of claim 3, further comprising a strip-running centering aid located upstream or downstream of the location of roll deformation and at a distance from the location of the strip diversion corresponding to 1.5 times to 5.0 times the strip width.

15. A startup method for an apparatus for continuously producing a rolled metal strip wherein the apparatus on which the method is performed comprises a strip casting device for producing a cast metal strip with an initially cast thickness of less than 20 mm; at least one rolling stand downstream along a path of the strip from the strip casting device and adapted for in-line roll forming of the cast, undivided metal strip, the rolling stand including a roll nip defined by and between working rollers and the nip being openable and being closeable to form the nip; a strip diverting device arranged between the strip casting device and the rolling stand for influencing the strip running direction of the metal strip along the path upstream of the rolling stand; a centering aid for centering the strip along the path; and a strip coiling device for winding up the rolled metal strip after it passes the rolling stand;

the method comprising:

after the metal strip exits the strip casting device, passing the strip along the strip path through the apparatus and threading the strip into the strip coiling device substantially at a strip running velocity along the path;

the rolling stand including the roll nip that is then open between the working rollers thereof, and the strip running velocity corresponding to a casting rate of the strip casting device;

setting a controlled strip tension between the strip diverting device and one of the strip running centering aid disposed along the strip path upstream of the rolling stand, or the strip running centering aid connected downstream of the rolling stand, or the strip coiling device;

either simultaneously or subsequently providing a controlled strip diversion to the metal strip at a distance upstream of the rolling stand on the path of the strip, and applying the diversion to the metal strip while the strip is under tension, at a distance upstream of the rolling stand on the path of 1.0 times to 10.0 times the width of the strip;

thereafter setting the working rollers of the rolling stand to form a roll nip which corresponds to the final strip thickness; and matching the rolling speed to the casting rate from the casting device.

16. The startup method of claim 15, wherein the controlled strip tension between the strip diverting device and the strip coiling device or a strip centering aid is at a value of between 2.0 MPa and 15 MPa.

* * * * *